United States Patent [19]

Smith

[11] 4,350,075

[45] Sep. 21, 1982

[54] OMNI PULL PERCUSSION FIRING MECHANISM

[75] Inventor: Thomas V. Smith, Troy, N.Y.

[73] Assignee: The United States of America as represented by the Secretary of the Army, Washington, D.C.

[21] Appl. No.: 143,656

[22] Filed: Apr. 25, 1980

[51] Int. Cl.[3] ..... F41F 13/04

[52] U.S. Cl. ..... 89/27 R

[58] Field of Search ..... 42/1 F, 1 G, 1 H, 1 Z; 89/1 B, 27 R, 27 F, 136; 102/428, 429

[56] References Cited

U.S. PATENT DOCUMENTS 3,885,761 5/1975 Pendergast et al. ..... 89/1 B
4,004,488 1/1977 Williams ..... 42/1 Z

FOREIGN PATENT DOCUMENTS 475979 8/1974 Australia ..... 102/429
2204615 8/1973 Fed. Rep. of Germany ..... 42/1 F

*Primary Examiner*—Stephen C. Bentley
*Attorney, Agent, or Firm*—Nathan Edelberg; Robert P. Gibson; A. Victor Erkkila

[57] ABSTRACT

A mechanical device for initiating the firing of a large cannon, comprising a cylindrical case with a generally cylindrical yoke slidably mounted therein with a generally cylindrical hammer in turn mounted in said yoke. A lever is held up against the aft end of the case by means of an internal spring. The device is cocked by moving the lever sidewise in any direction, or directly aft. During cocking the hammer and yoke are moved aft. Upon completion of the cocking movement, the hammer is automatically released and moves forward to strike the firing pin. Upon release of the lever, the yoke and other parts are automatically reset under the action of springs.

4 Claims, 3 Drawing Figures

OMNI PULL PERCUSSION FIRING MECHANISM

The invention described herein may be manufactured and used by or for the United States Government for governmental purposes without the payment of any royalties therefor or thereon.

BACKGROUND OF THE INVENTION

The field of this invention is mechanical firing devices intended for use on large cannons of the 8 inch, 155 mm and 175 mm types. Such devices utilize the kinetic energy in a moving hammer to actuate a firing pin, which in turn sets off the fuze or primer in the round or shell to fire the cannon. The present invention achieves this function by means of novel apparatus which can be easily and economically made and assembled, and which can be easily actuated by moving a lever approximately 40 degrees sideways in any direction or by pulling it a short distance directly to the rear or aft. A lanyard can be attached to the lever for convenient remote orientation thereof. Upon release of the lever, the device automatically resets itself through the action of springs. The name "omni pull" has been chosen because of the ease and convenience of operation of the device.

SUMMARY OF THE INVENTION

The novel firing mechanism comprises a hammer of generally cylindrical shape but with an annular groove just aft of its midpoint. The hammer is inserted into a cylindrical yoke having an inside diameter just slightly larger than the outside diameter of the main body of the hammer. A pair of cage holes through the sidewalls of the yoke are adapted to receive a pair of balls. In the battery position these balls ride the aforementioned groove in the hammer and cage holes and thus clutch the hammer and yoke together. A moveable sleeve is mounted on the outside of the yoke. The sleeve has an annular groove located near its aft end. All of the aforementioned parts are nested inside of a cylindrical case with the yoke inserted into a hole at the center of the aft end of the case. A cylindrical cup with a central hole through which the flanged forward end of the hammer projects helps to guide the hammer in its fore aft movement, and connects the hammer to its actuating spring which imparts its forward motion. The actuating lever is held up against the aft end of the case by means of a pivot or link comprising a rod with bulbous end portions which engage mating recesses in the lever and the aft end of the yoke. A spring inside the device urges the yoke forward to hold the lever in place.

Upon movement of the lever sidewise in any direction or directly aft, the pivot moves the yoke aft relative to the case. The captive balls in the yoke engage the groove in the hammer to carry the hammer aft with the yoke. When the balls reach the groove in the sleeve, the spring which urges the cup and hammer forward will cam the balls out of the hammer groove and into the sleeve groove, and the hammer and cup will be impelled forward to strike the firing pin. When the actuating lever is subsequently released, another spring between the yoke and the inside aft end of the case carries the yoke and sleeve forward. When the balls, which are being carried forward in the annular groove of the sleeve and the cage holes in the yoke, reach the groove in the hammer, they are cammed out of the sleeve groove and back to their battery position by means of a spring which urges the sleeve aft. The device is then fully reset to the battery position. The operation of the lever thus cocks the mechanism, and it automatically fires when the cocking motion is complete. Upon release of the lever, the springs automatically reset the device, as explained above. Further details of the structure and mode of operation will become apparent from the drawings and the detailed description.

DETAILED DESCRIPTION OF A PREFERRED EMBODIMENT

Figure 1:
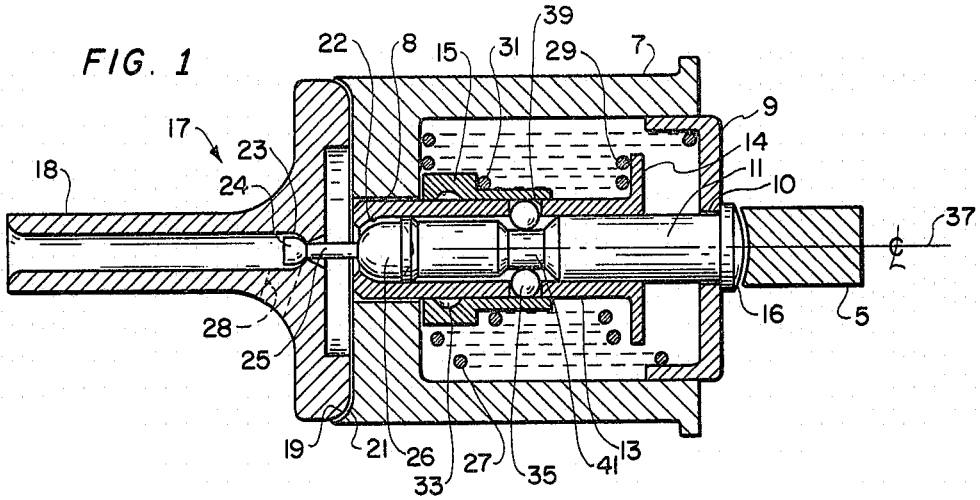
FIG. 1 is a cross-sectional view of the firing mechanism in the battery position.

In the cross-sectional view of FIG. 1, the firing mechanism is shown ready to be cocked and fired, with the hammer 11 resting up against the firing pin 5. This is known as the battery position. All of the major parts of the mechanism, except for the springs and the balls, are figures of revolution obtained by rotating the cross-sectional shapes in FIG. 1 around the center line 37. Thus only a single view is necessary to completely describe the shape of the components in three dimensions. This fact also makes the device easy to manufacture and assemble, since most of the parts can be produced on a lathe or automatic screw machine. Further, the fact that most of the parts nest within a larger part results in a simple and reliable mechanism.

In FIG. 1, the case 7 is generally cylindrical with its forward end (the right hand end in the drawing) open, and a circular hole 8 in the center of its aft end. The yoke 13 is a cylinder with a flange 14 at its forward end. A pair of circular cage holes 39 are drilled at diametrically opposed points in the surface of the yoke. The hammer 11 is inserted into the bore in the yoke for sliding movement therein. Just aft of its midpoint there is an annular groove 41 in the hammer. In the battery position of FIG. 1, the cage holes in the yoke and the groove in the hammer are aligned with each other, and a pair of captive balls 35 hold these two parts together. The portion of the hammer forward of the groove 41 fits snugly inside of the yoke, whereas the hammer diameter is somewhat rendered aft of the groove to facilitate the motion of the balls during the resetting of the device. The aft end of the bore in the yoke tapers to a spherical shape 22, as shown, to accommodate the bulbous end 26 of the pivot 25. The end 26 projects slightly into a recess in the aft end of the hammer. The other end of the pivot has a smaller bulbous end 24 which engages a spherical recess 23 in lever 17. The lever 17 has a circular base with rounded ends 19 which fit inside of a mating curved flange 21 in the aft end of the case 7. The lever has a central upstanding stem 18 with a central bore therein which terminates in the spherical recess or seat 23. The pressure of the internal springs, acting through the yoke and the pivot, hold the lever up against the aft end of the case and the flange 21 and the rounded portion 19 of the lever aid in aligning these two parts as the lever is operated and released. A hole 28 in the forward end of the lever allows the end 24 of the pivot to be easily inserted in its seat 23.

The forward end of the hammer passes through a central hole 10 in the cup 9, which is a cylinder nested in the forward end of the case. The flange 16 at the forward end of the hammer has a larger diameter than that of the hole 10, so that the hammer and cup move forward and aft in unison. The sleeve 15 fits over and slides on the outside of the yoke. The sleeve has, near its aft end, an annular slot or groove 33, adapted to receive the balls 35. The outside diameter of the sleeve is stepped, as shown, so that the spring 31 may engage it.

There are three helical springs in the mechanism, all having their central axes disposed along the center line 37, but each having a different turn diameter, so that the three springs are nested, as shown. The outer spring 27 bears against the inside of cup 9 and the inside of the base of the case, and thus when compressed urges the cup and the hammer, connected thereto through its forward flange, toward the right or forward. The intermediate spring 29 connects the flange 14 of the yoke to the inside of the case to urge the yoke in the forward direction. The innermost spring 31 is connected between the flange of the yoke and the step in the outside of the sleeve 15 to urge these parts in opposite directions.

Figure 2:
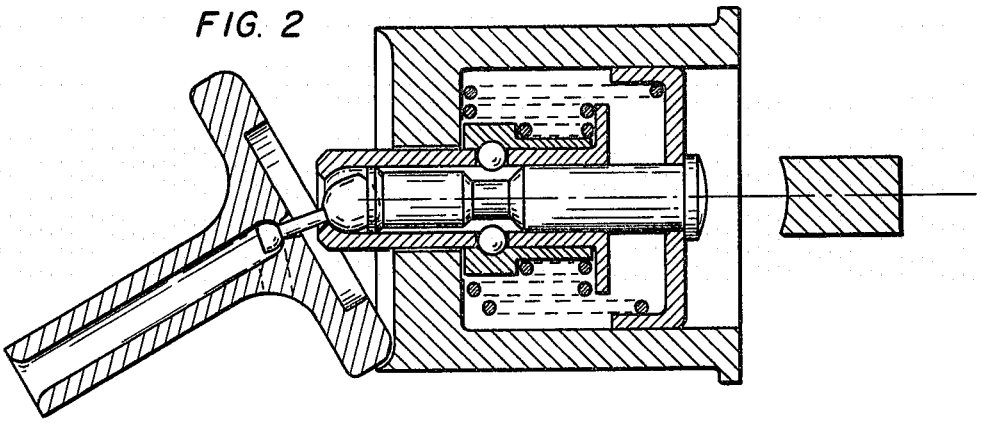
FIG. 2 is a similar view of the device after cocking but just before the hammer is released to be driven forward into the firing pin.
Figure 3:
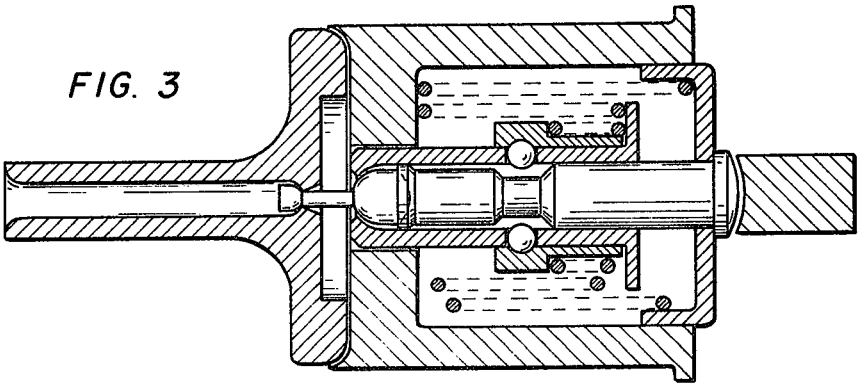
FIG. 3 shows the position of the parts after release of the lever and the resetting of the yoke, but before the resetting of the sleeve.

FIGS. 2 and 3 show all of the same components as FIG. 1, but with some of them in different positions, hence the reference characters in these two figures have been omitted for added clarity.

In FIG. 2 the lever is shown deflected downward approximately 40 degrees as it might be during a typical firing of the cannon. At the point illustrated, the movement of the lever has moved the yoke aft through its connection via the pivot. The hammer and the cup have been carried with the yoke through the clutching action of the balls in the cage holes and the hammer groove. In FIG. 2 the balls have just reached the groove in the sleeve and have been cammed into the sleeve groove and the cage holes by the pressure of the outer spring 27 which urges the cup and hammer forward. The cup and hammer are thus free to move forward and strike the firing pin 5. After this happens the cup and hammer are reset to the battery position, but the yoke, sleeve and lever will remain in their FIG. 2 positions until the lever is released. Upon release of the lever, the intermediate spring 29 will move the yoke and the sleeve and the balls, which now connect these two parts, forward. When the captive balls reach the hammer groove, the resetting of the yoke will be complete. This point is illustrated in FIG. 3, which is the same as FIG. 1 except that the sleeve has been carried forward so that its groove is aligned with both the cage holes and the hammer groove. At this point the inner spring urges the sleeve back to its battery position and thus forces the balls into their battery position connecting the yoke and the hammer. The sleeve is now free to move aft and it does, to complete the resetting of the device.

Assembly of the device is easily accomplished in the following manner: The pivot is inserted into the yoke, the hammer into the cup and then the hammer into the yoke; the balls are inserted into the cage holes, and then the sleeve and its spring over the aft end of the yoke. The outer and intermediate springs are then inserted in the cup and yoke respectively, and the case slid over this subassembly. The small end of the pivot will now be projecting through the hole in the aft end of the case. The springs must be held compressed while the smaller end of the pivot is seated in the bore of the lever through the hole 28.

While the invention has been described in connection with a preferred embodiment, variations therein will occur to those skilled in the art, thus the invention should be limited only by the scope of the appended claims.

I claim:

1. A percussion type firing mechanism adapted to actuate the firing pin of a large cannon, comprising; a generally cylindrical hammer aligned with said firing pin, said hammer having an annular groove just aft of its midpoint and a flange at its forward end, said hammer being slidably mounted in a bore in a cylindrical yoke, the portion of said hammer between said annular groove and said flange closely fitting said bore in said yoke and the portion of said hammer aft of said annular groove being of reduced diameter, a pair of cage holes in the sidewalls of said yoke at diametrically opposed points, a pair of balls held captive in said cage holes; said mechanism further comprising a generally cylindrical case with a central hole in the base or after end thereof, said hole being big enough to snugly accommodate the outside diameter of said yoke, said bore in said yoke tapering at its aft end to a spherical shape and communicating to a hole in said aft end, a pivot comprising a rod with large and small bulbous end portions, said large bulbous end portion being inserted into the aft end of said yoke and engaging said spherical shape, a lever comprising a circular base with a central upstanding stem integral therewith, having its base attached to the aft end of said case, said aft end of said case having a rim portion adapted to receive and contain said circular base of said lever, a bore in said stem terminating in a spherical section near the base of said lever, the other end of said pivot engaging said spherical section of said bore to hold said lever onto the aft end of said case; a cylindrical cup with an outside diameter slightly smaller than the inside of said case and a central hole in the forward end thereof with a diameter equal to that of said bore in said yoke, said cup being nested inside said case with the flanged head of said hammer projecting through the central hole therein, a cylindrical sleeve with a stepped outside diameter slidably mounted over said yoke, an annular groove on the inside of said sleeve near the aft thereof, three helical coil springs mounted within said case with their axes co-linear but with different turn diameters, the outmost of said springs being mounted between the inside of said cup and the base of said case, the intermediate spring being connected between a flange at the forward end of said yoke and the base of said case, and said innermost spring being connected between said stepped portion of said sleeve and said flange on said yoke.

2. A mechanism for cocking, releasing and resetting a hammer of a percussion type firing mechanism comprising:

a generally cylindrical case having a forward open end and an axial hole in the aft end thereof;

a generally cylindrical yoke slidably mounted in said axial hole, said yoke having an axial bore therein, a pair of cage holes in the sidewalls thereof, and a flange at its forward end;

a cylindrical cup having an outside diameter slightly smaller than the inside diameter of said case and slidably mounted in said case, said cup having a central aperture in the forward end thereof with a diameter equal to that of said bore in said yoke;

a generally cylindrical hammer having an annular groove and a flange at its forward end, slidably mounted in said bore of said yoke and said aperture of said cup, said flange projecting through said aperture and acting on the forward face of said cup;

clutching means to normally couple said hammer and yoke together comprising a pair of balls, which in the battery position of said mechanism and during cocking thereof ride in said pair of cage holes in said yoke and in said annular groove in said hammer;

two coil springs mounted about said yoke within said case with their axes co-linear but with different turn diameters, the first of said springs being mounted between the inside of said cup and the aft end of said case to bias said hammer in a forward direction, and the second of said springs being mounted between the flange of said yoke and aft end of said case to bias said yoke in a forward direction; lever means attached to the aft end of said case adapted to move said yoke and hammer aft relative to said case to compress said coil springs and cock said firing mechanism; and means to automatically disengage said clutching means when said mechanism has been fully cocked, thereby permitting said first spring to impel said hammer in the forward direction to initiate the firing of said cannon, said second spring subsequently resetting said yoke to its battery position and re-engaging said clutching means.

3. The mechanism of claim 2, wherein the means to automatically disengage said clutching means comprises a generally cylindrical sleeve slidably mounted on said yoke, said sleeve having a stepped outside diameter and an annular groove on the inside surface thereof near the aft end thereof, and a coil spring mounted over said yoke between the flange of said yoke and the stepped portion of said sleeve to bias said sleeve in the aft direction, whereby upon completion of the cocking of said mechanism said balls are cammed into said annular groove of said sleeve to release said hammer for forward motion.

4. The mechanism of claim 2 or 3, wherein said lever means comprises a circular base portion having a diameter approximately equal to the outside diameter of said case, and a central upstanding stem, said case having a rim portion at its aft end adapted to receive and constrain said circular base of said lever, whereby said mechanism may be cocked and fired by moving said stem sidewise in any direction as well as directly aft.

* * * * *